US007808351B2

(12) United States Patent
Forsberg et al.

(10) Patent No.: US 7,808,351 B2
(45) Date of Patent: Oct. 5, 2010

(54) HIGH VOLTAGE TRANSFORMER WITH A SHIELD RING, A SHIELD RING AND A METHOD OF MANUFACTURE SAME

(75) Inventors: Erik Forsberg, Smedjebacken (SE); Tony Polander, Söderbärke (SE); Lars-Åke Svensson, Ludvika (SE); Lars-Erik Vennerberg, Ludvika (SE)

(73) Assignee: ABB Technology Ltd., Zürich (CH)

( * ) Notice: Subject to any disclaimer, the term of this patent is extended or adjusted under 35 U.S.C. 154(b) by 0 days.

(21) Appl. No.: 12/439,547

(22) PCT Filed: Aug. 17, 2007

(86) PCT No.: PCT/SE2007/050559

§ 371 (c)(1),
(2), (4) Date: Mar. 2, 2009

(87) PCT Pub. No.: WO2008/026992

PCT Pub. Date: Mar. 6, 2008

(65) Prior Publication Data

US 2010/0007452 A1 Jan. 14, 2010

(30) Foreign Application Priority Data

Aug. 28, 2006 (SE) ..... 0601760

(51) Int. Cl.
*H01F 27/32* (2006.01)
*H01F 27/24* (2006.01)

(52) U.S. Cl. ..... 336/84 R; 336/212; 336/90

(58) Field of Classification Search ..... 336/84 R, 336/90, 192, 229, 212, 198, 70
See application file for complete search history.

(56) References Cited

U.S. PATENT DOCUMENTS 6,351,202 B1 * 2/2002 Ito et al. ..... 336/15

FOREIGN PATENT DOCUMENTS

JP 59-88810 5/1984

(Continued)

OTHER PUBLICATIONS

PCT/ISA/210—International Search Report—Nov. 13, 2007.

(Continued)

*Primary Examiner*—Anh T Mai
(74) *Attorney, Agent, or Firm*—Venable LLP; Eric J. Franklin

(57) ABSTRACT

A high voltage transformer including a transformer housing. Internal components and provided in the transformer housing. The internal components are submerged in transformer oil and are provided with insulation for insulating a high voltage winding end. The insulation includes a shield ring arranged above the winding end and a pressboard structure formed in a zigzag pattern arranged around the winding end. The shield ring includes a core covered with a conducting layer and a continuous solid insulation layer outside the conducting layer. The insulation layer includes integrated solid insulation sections of which at least some among themselves having varying thickness. Also a shield ring and a method of manufacture the shield ring.

8 Claims, 2 Drawing Sheets

FOREIGN PATENT DOCUMENTS

| | | | | |
|---|---|---|---|---|
| JP | 61-100906 | | | 5/1986 |
| JP | 01037815 | A | * | 2/1989 |
| JP | 02148810 | A | * | 6/1990 |
| JP | 3-285310 | | | 12/1991 |
| JP | 03289110 | A | * | 12/1991 |

OTHER PUBLICATIONS

PCT/IPEA/409—International Preliminary Report on Patentability—Mar. 3, 2008.

Xiang et al., Design of insulated structure for load-ratio voltage power transformer by finite element method, IEEE Transactions on Magnetics, vol. 30, No. 5, Sep. 1994.

* cited by examiner

HIGH VOLTAGE TRANSFORMER WITH A SHIELD RING, A SHIELD RING AND A METHOD OF MANUFACTURE SAME

CROSS-REFERENCE TO RELATED APPLICATIONS

This application claims priority to Swedish patent application 0601760-2 filed 28 Aug. 2006 and is the national phase under 35 U.S.C. §371 of PCT/SE2007/050559 filed 17Aug. 2007.

FIELD OF INVENTION

The present invention relates to a high voltage transformer comprising transformer housing;, internal components, such as transformer core, yokes and windings, provided in the transformer housing, the internal components being submerged in transformer oil, wherein the internal components are provided with insulation structure comprising means for insulation the high voltage winding end, which insulation means comprises a shield ring arranged above the winding end and a pressboard structure formed in a zigzag pattern arranged around the winding end and said shield ring, which shield ring comprises a core, covered with a conducting layer, potentially connected to the winding end and a continuous solid insulation layer outside the conducting layer.

The invention also relates to a shield ring for use in power transformers and reactors and submersed in transformer oil, comprising a core covered by a conducting outer layer and a continuous outer solid insulation layer outside the conducting layer.

The invention also relates to a method of manufacture a shield ring for use in high voltage transformers and reactors.

BACKGROUND

It is known that electrical equipment and devices, such as high voltage power transformers, are usually equipped with insulation systems based on cellulose materials and transformer oil. Insulation systems are used to insulate parts of the transformer connected to high potential from parts connected to other voltages or ground. Often the method of subdivision of oil volumes is used to increase the withstand strength of oil.

A main insulation problem at a core-type transformer is the problem of insulating high voltage windings from the core and from neighboring windings. In the winding insulation solutions used, a structure called a shield ring is often used to help deal with the stress on the corners of the windings which are made as cylindrical shells.

An example of prior art shield ring adapted for use with a high voltage power transformer will now briefly be described with reference to FIG. 1.

The winding end 1 of high voltage winding in a power transformer is shielded by an insulation structure consisting of pressboard barriers 2 which form a zig-zag pattern in surrounding transformer oil 3.

In the winding end 1, a shield ring 4 is used to increase the insulation on the corners of the winding more than is possible by adapting the insulation of current-carrying conductor of the winding itself. The shield ring 4 is built up from a core 5 and is circularly cylindrical. The outer layer of the core is covered with a conducting layer 6 which is potentially bound to the winding. The outer layer thus forms the electrode shape of the shield ring 4. Outside the electrode layer 6 of the shield ring 4 is a layer with solid insulation 7, preferably cellulose material. The layer 7 is thus facing the transformer oil 3.

The amount of solid insulation 7 material covering the conducting layer 6 on the core 5 of the shield ring 4 is exclusively homogeneously applied The shield ring 4 has a few key properties. The most fundamental one is to insulate the corner of the winding, but the design of the shield ring also influence the oil flow that cools the winding, since the oil flows past the shield ring. Further, it transfers the spring force (vertical in figure) which is applied to the winding from the yokes to keep the winding firmly seated.

Prior art shield rings are constituted as so that the amount of solid insulation material 7 is homogeneously applied, which means that the mechanical, thermal and electrical properties of the shield ring are tightly bound together.

SUMMARY OF THE INVENTION

The present invention seeks to provide a high voltage transformer with a shield ring having reduced electrical stress in transformer oil in critical areas outside the shield ring, still having high mechanical strength and thermal properties in part of the shield ring subjected to high mechanical forces as well as high demands on thermal properties.

The present invention also seeks to provide a shield ring having properties mentioned above.

Further, the present invention seeks to provide a method of manufacture a shield ring for use in high voltage transformers.

The invention is based on the realization that mechanical, thermal and electrical properties of the shield ring can only be combined with an inhomogeneous application of solid insulation 7 on the core 5, since the demands would be contradicting each other in the case of a homogeneous application, where the large amount of solid insulation on the corners of the shield ring would prohibit oil-flow and worsen mechanical properties, if the protection of the winding corner would need to be achieved. By this reason, the shield ring according to the invention has superior properties as regards compared with prior art shield rings.

According to one aspect of the invention there is provided for a high voltage power transformer, and according to an other aspect of the invention there is provide a shield ring, and according to still another aspect of the invention there is provided a method of manufacturing a shield ring.

With the inventive arrangement, several advantages are obtained. The amount of solid insulation on the corners of the shield ring, thus lowering the electric stress in oil outside the shield ring solid insulation layer by taking a higher degree of voltage drop in the solid insulation itself (which is advantageous since it is dielectrically stronger), is rather high in the invention. In order to transfer the spring force of the winding efficiently towards the yoke, the amount of solid insulation in the vertical direction is on the other hand limited.

By the invention it is thus possible to adapt the amount of solid insulation in every direction to meet specific needs.

BRIEF DESCRIPTION OF THE DRAWINGS

The invention is now described, by way of example, with reference to the accompanying drawings, in which.

DETAILED DESCRIPTION OF PREFERRED EMBODIMENTS

In the following a detailed description of a preferred embodiment of the present invention will be given.

Figure 1:
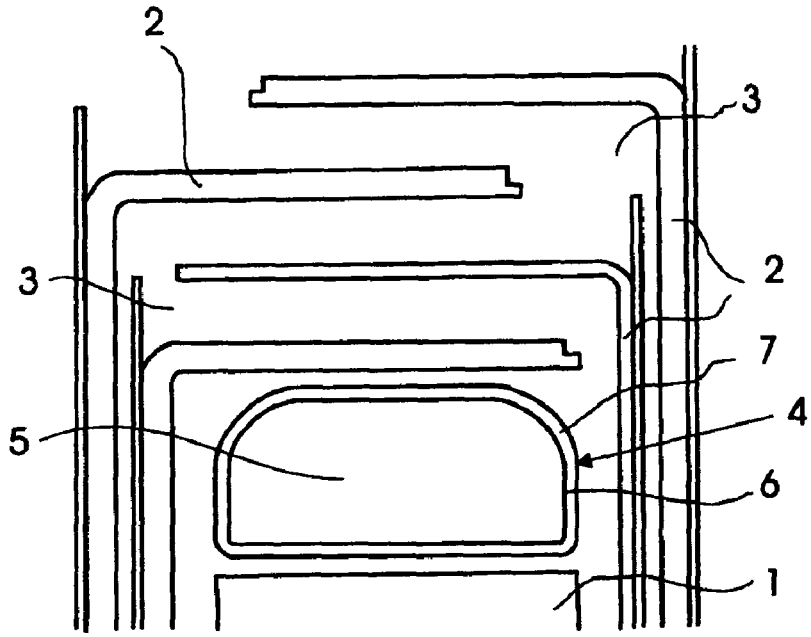
Fig. 1 Prior Art
FIG. 1 is a schematic cross section view of a prior art shield ring and surrounding insulation structure.

A prior art shield ring and surrounding insulation structure has been described in the background section with reference to FIG. 1 and this figure will not be further discussed herein.

Figure 2:
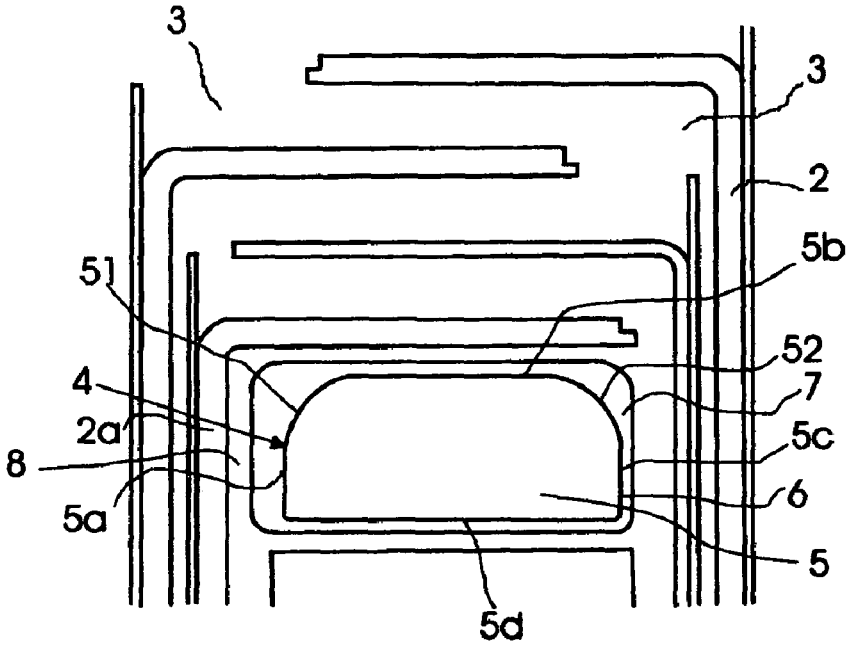
FIG. 2 is a schematic cross section view of a shield ring and surrounding insulation structure according to the invention.
Figure 3:
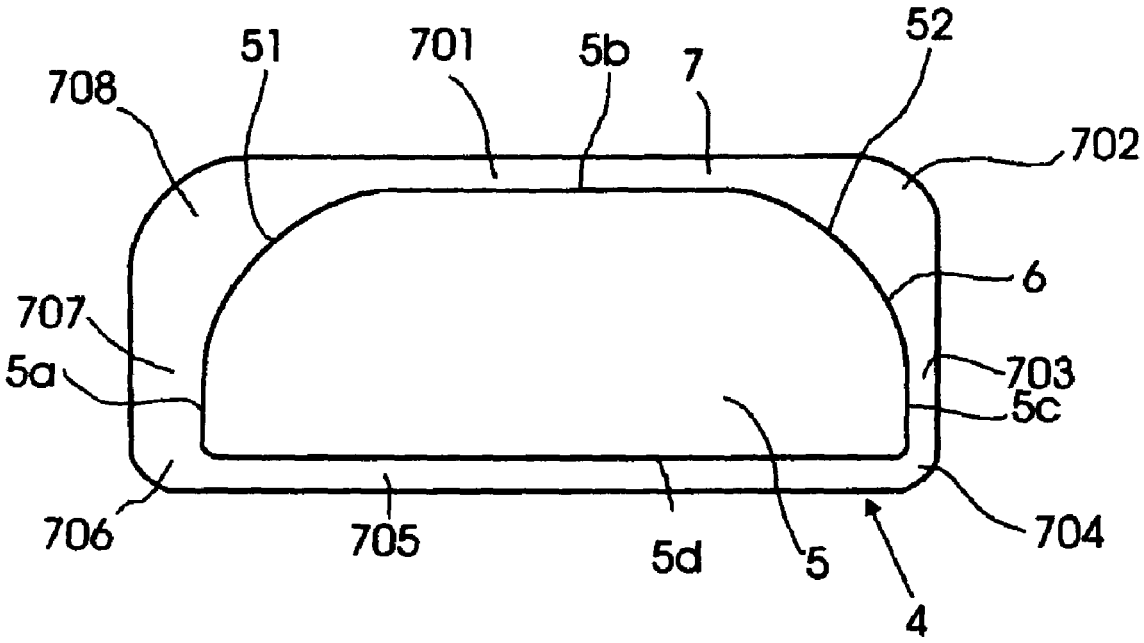
FIG. 3 is a schematic cross section view illustrating a shield ring according to the invention in detail.

In FIG. 2, there is shown a view of a shield ring 4 and surrounding insulation structure according to the invention and FIG. 3 is a schematic cross section view illustrating a shield ring according to the invention in detail.

In FIG. 2, 1 is the winding end 1 of high voltage winding in a power transformer, which is shielded by an insulation structure consisting of pressboard barriers 2 which form a zigzag pattern in surrounding transformer oil 3. 4 is a shield ring used to increase the insulation on the corners of the winding end 1 more than is possible by adapting the insulation of current-carrying conductor of the winding itself. The shield ring 4 is built up from a core 5, which have an inside side 5*a*, facing the transformer core (not shown) and upper horizontal side 5*b*, facing the yoke (not shown) an outside side 5*c*, and a lower horizontal side facing 5*d* the end winding 1. 51 and 52 designates the upper corners of the core 5.

The outer layer of the core is covered with a conducting layer 6, preferably alumina foil, which is potentially bound to the winding. The outer layer thus forms the electrode shape of the shield ring 4. Outside the electrode layer 6 of the shield ring 4 is a layer with solid insulation 7, preferably cellulose material. The layer 7 is facing the transformer oil 3.

In FIG. 3, the shield ring 4 according to the invention is illustrated schematic in detail, where the continuous solid insulation layer 7, applied on the core 5, comprises sections 701-708, where

701 is the section of the insulation applied on the upper side 5*b* of core 5,

703 is the section applied on the vertical side 5*c* of core 5,

705 is the section applied on the horizontal side 5*d* of core 5

707 is the section applied on the vertical side 5*a* of core 5, while 708 and 702 are sections of the solid insulation forming the upper corners around the core 5, and 704 and 706 are the sections forming the lower corners around the core 5.

The core 5 typically shows a horizontal diameter in the interval of 0.5 m and 4.0 m, preferably in the interval between 1.5 m and 3.0 m. and a height in the interval of 10 mm and 100 mm. In the figure, to facilitate understanding, the thickness of layer 7 and the height of the core 5, compared with the diameter of the core, have been much exaggerated.

The amount of solid insulation 7 is inhomogeneous applied to the outer layer 6 of core 5, so that the continuous solid insulation layer 7 comprises integrated solid insulation sections 701-708, of which at least some having varying thickness, and thereby adapted to specific mechanical, thermal and electrical needs of the shield ring 4.

The electrical needs are optimized by increasing the amount of solid insulation on corners 708, 702 facing away from the winding 1. Preferably the thickness is at least twice the highest thickness of insulation sections 701, 705. By this measure, a larger voltage drop is achieved in solid insulation which has a higher electrical withstand strength than oil.

Preferably a thicker layer 707 of solid insulation is applied on the inside part 5*a* than on the outer insulation section 703, Hereby a smaller oil volume is created in a path 8 formed between the shield ring and the pressboard barrier 2*a*, whereby a higher electrical withstand strength is obtained. Thermally, still sufficient properties are achieved by maintaining a large enough oil gap to the first barrier 2*a* on the outside of the winding to give the cooling oil of the winding an unrestricted oil flow path through the pass 8.

On the other hand, based on a mechanically aspect, a rather low amount of solid insulation is applied in the vertical direction on the upper part 5*b*, forming the solid insulation section 701, of the shield ring facing the yoke (not shown), and further a rather low amount of solid insulation is also applied in the vertical direction on the lower part 5*d* of the shield ring facing the winding 1, forming the solid insulation section 705. Hereby, it is possible to maximize the transferred force to the winding without loosing pressure in compressing large amounts of soft solid insulation.

Typically, the highest thickness of the insulation sections forming the upper corners 708, 702 is in the interval between 10 mm-30 mm, preferably in the interval between 15 mm-20 mm, and the insulation sections forming upper and lower horizontal insulating sections 701, 705 is in the interval between 3 mm-8 mm, preferably in the interval between 4 mm-6 mm.

The core 5 is preferably made of presspan. The solid insulation 7 is made of a material which can be impregnated by transformer oil. Examples of such materials are paper, pressboard, Nomex. The means for insulation the high voltage transformer preferable designed for AC/DC voltages over 500 kV, preferably 800 kV and up to 1200 kV.

The present invention also refers to a method of manufacture a shield ring for use in high voltage transformers.

The application of uneven amounts of solid insulation requires several steps in the production of the shield ring, where different amounts of insulation material are applied in several steps.

The method comprises the following steps:

manufacture of the core 5, preferable of presspan:

applying a conducting layer 6 outside the core 5;

applying solid insulation material, such as paper, pressboard, Nomex, on the conducting layer 6 in several separate operations in order to form a continuous solid insulation layer 7.

As the solid insulation layer 7 comprises solid insulation sections 701-708 of different thickness of the insulation, the amount of insulation material applied in each operation and number of operations are adapted to the thickness of the solid insulation sections, so more insulation material are applied to section having a thicker insulation layer compared to a section having thinner insulation layer.

Preferred embodiments of a high voltage shield ring arrangement and a high voltage transformer have been described. A person skilled in the art realizes that these could be varied within the scope of the appended claims. Although the inventive idea is based on the use of a shield ring at a high voltage transformer, it will be appreciated that the shield ring also can be used in a high voltage reactor.

The invention claimed is:

1. A high voltage transformer, comprising:

a transformer housing;

internal components provided in the transformer housing, the internal components being submerged in transformer oil, wherein the internal components comprise an insulation structure for insulating a high voltage winding end, the insulation comprising a shield ring arranged above a winding end and a pressboard structure formed in a zigzag pattern arranged around the winding end and said shield ring, shield ring comprising a core covered with a conducting layer potentially connected to the winding end and a continuous solid insulation layer outside the conducting layer, wherein the continuous solid insulation layer comprises integrated solid insulation sections of which at least some have varying thickness and an inner insulation section facing the transformer core that is thicker than outer insulation section.

2. The high voltage transformer according to claim 1, wherein the insulation sections include upper corners having a highest thickness which is at least twice a highest thickness of insulation sections forming upper and lower horizontal insulating sections.

3. The high voltage transformer according to claim 1, wherein the core has a horizontal diameter in the interval of 0.5 m -40 m, and a height in the interval of 10 mm and 100 mm.

4. The high voltage transformer according to claim 1, wherein a highest thickness of the insulation sections forming upper corners is in the interval between 10 mm -30 mm, and the insulation sections forming upper and lower horizontal insulating sections has a highest thickness in the interval between 3 mm-8 mm.

5. The high voltage transformer according to claim 1, wherein the core comprises presspan, wherein the and solid insulation layer comprises material to be impregnated by transformer oil.

6. The high voltage transformer according to claim 1, wherein the insulation is designed for AC/DC voltages over 500 kV.

7. A shield ring for use in power transformers and reactors and submersed in transformer oil, the shield ring comprising a core, a conducting outer layer covering the core, and a continuous outer solid insulation layer outside the conducting layer, wherein an amount of solid insulation in every direction is adapted to specific needs, and wherein where demand of high mechanical strength is high, the amount of solid insulation is small and an inner insulation section facing the transformer core is thicker than outer insulation section.

8. A method for manufacturing a shield ring for use in high voltage transformers and reactors, the method comprising:

manufacture of core;

applying a conducting layer outside the core;

applying solid insulation material on the conducting layer in several separate operations forming a continuous solid insulation layer;

wherein an amount of insulation material applied in each operation and number of operations are adapted to a thickness of each of solid insulation section, and wherein an inner insulation section facing the transformer core is thicker than outer insulation section.

* * * * *